United States Patent [19]

Amelot et al.

[11] 4,121,516

[45] Oct. 24, 1978

[54] SHEET-METAL MARKING PRESS

[76] Inventors: Bernard Amelot, 26 Avenue des Adages, 95220 Herblay; Roger Batard, 6 rue de la Porte des Pres, 95100 Argenteuil; Claude Bimbert, 8 Allee des Jonquilles, 93360 Neuilly-Plaisance; Georges Boulvard, 17 rue Alfred de Musset, 93290 Tremblay les Gonnesse; Alain Leclert, 13 Avenue des Sablons, 91350 Grigny 2, all of France

[21] Appl. No.: 756,352

[22] Filed: Jan. 3, 1977

[51] Int. Cl.[2] ..... B44B 5/00

[52] U.S. Cl. ..... 101/23; 101/212

[58] Field of Search ..... 101/6, 5, 23, 25, 4, 101/10, 22, 212, 232–235

[56] References Cited

U.S. PATENT DOCUMENTS

| | | | |
|---|---|---|---|
| 500,998 | 7/1893 | Davis | 101/23 |
| 510,377 | 12/1893 | Brausil | 101/6 |
| 602,560 | 4/1898 | Leonard | 101/25 |
| 801,107 | 10/1905 | Robin | 101/6 |
| 1,256,342 | 2/1918 | McGrath | 101/4 UX |
| 2,641,998 | 6/1953 | Donald | 101/23 UX |
| 3,122,993 | 3/1964 | McKay | 101/212 X |
| 3,269,304 | 8/1966 | Godfrey | 101/23 |
| 3,320,876 | 5/1967 | Salvatore | 101/23 |
| 3,636,866 | 1/1972 | Stommel et al. | 101/22 |
| 3,815,494 | 6/1974 | Bahnmuller | 101/23 |

FOREIGN PATENT DOCUMENTS

| | | | |
|---|---|---|---|
| 2,334,309 | 1/1975 | Fed. Rep. of Germany | 101/6 |
| 1,130,771 | 10/1956 | France | 101/212 |
| 1,237,233 | 6/1971 | United Kingdom | 101/25 |

*Primary Examiner*—Clifford D. Crowder

[57] ABSTRACT

This marking press for sheet metal articles and stock comprises a frame structure having a vertically adjustable cross member supporting an oscillatable embosser carrying the marking punch and, underneath, a roller for driving the sheets to be marked. Springs compensate the weight of the oscillatable embosser, cross member and fly bearings. A fluid-actuated cylinder and piston unit is provided for maintaining the oscillatable embosser in its downstream end position after the marking step proper and returning said oscillatable embosser to its upstream end position before the next marking step, without interfering with the driving of said oscillatable embosser by the passing sheet. Worms and nuts are provided for adjusting the position of said cross member as a function of the sheet thickness.

7 Claims, 2 Drawing Figures

SHEET-METAL MARKING PRESS

BACKGROUND OF THE INVENTION

1 Field of the invention

This invention relates in general to presses for marking sheet-metal, and is directed to improve the construction, efficiency and mode of operation of presses of this character.

It is known that in certain cases sheet-metal articles or plates must be marked, either compulsorily or for the sake of convenience, notably in the case of high-strength sheets, which must be checked one by one by a personnel skilled in the art, these sheets being utilized in certain manufacturing processes only if duly marked.

Some manufacturers are also desirous to mark sheet-metal articles or stock produced in their factories, even if this step is not compulsory, so that they can take advantage of a distinguishing mark.

As a rule, sheet metal is marked by hand by using the punch held by the checker. However, a machine specially designed for this purpose is also known, but its cost is extremely high due to the complicated electronic system required for obtaining a continuous marking of the sheets at their normal rate of feed which may be for example of the order of 80 to 120 m/mn.

2 Description of the invention

It is the essential object of the present invention to provide a press for marking sheet-metal articles, which is both extremely reliable and of relatively low cost.

For this purpose, the press for marking iron or steel sheets according to this invention is characterised in that it comprises on a same frame structure and in co-operative relationship a roller for driving the sheets to be marked, which rotates at a peripheral velocity equal to the linear feed rate of the sheets, and an oscillatable embosser mounted for free oscillation about its axis between two end positions, namely its upstream and downstream end positions, respectively, the arrangement being such that in any of these two positions said oscillatable embosser does not contact the sheet and can be locked, said fly consisting essentially of a cylindrical segment carrying on its outer periphery the necessary marking punches, in combination with means for adjusting the position of the axis of said oscillatable embosser in relation to that of said driving roller, according to the thickness or gage of the sheets to be marked, and means for releasing said oscillatable embosser from its upstream position, to permit the marking of the sheet travelling through the press, means for holding said oscillatable embosser in its downstream end position, the marking step proper, other means for subsequently returning said oscillatable embosser from its downstream end position to its upstream end position, between the passage of two successive sheets.

DESCRIPTION OF THE PREFERRED EMBODIMENT

Figure 1:
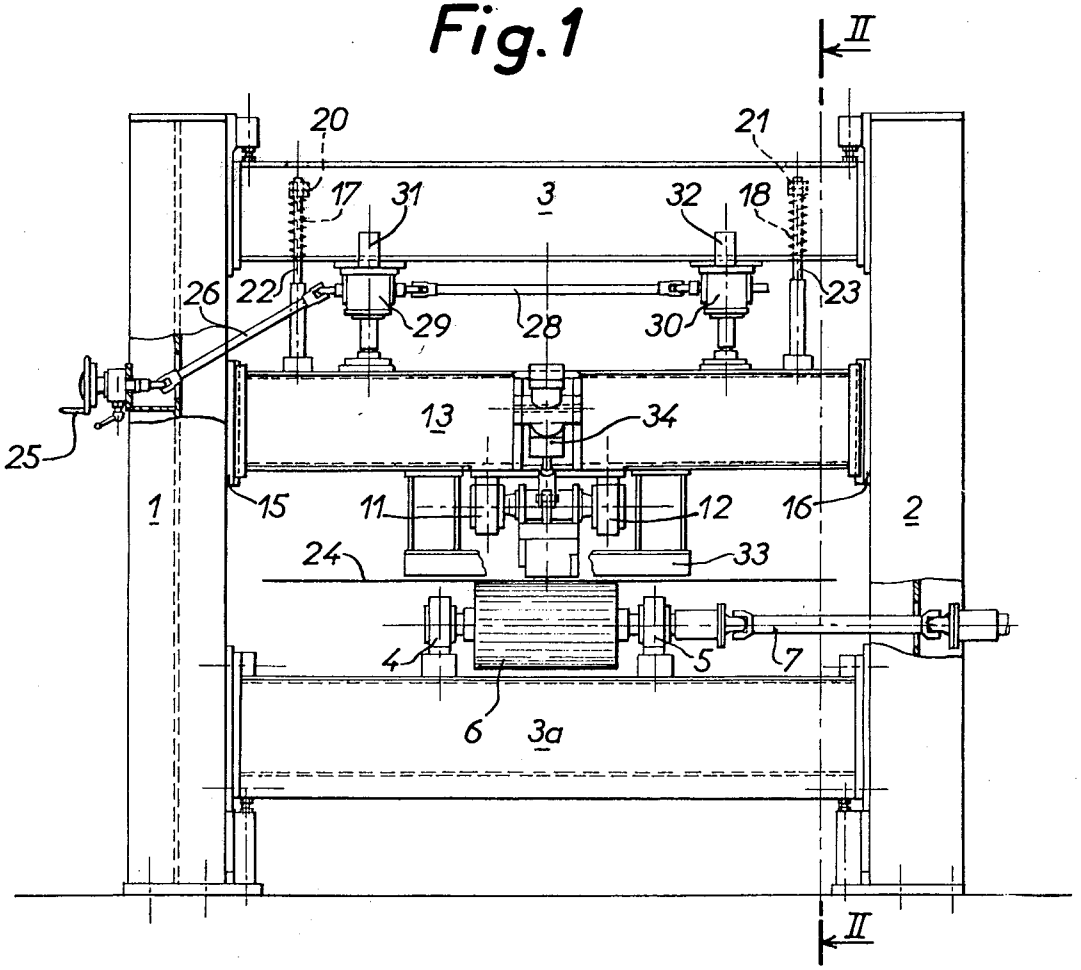
FIG. 1 is a front elevational view of the marking press of this invention.
Figure 2:
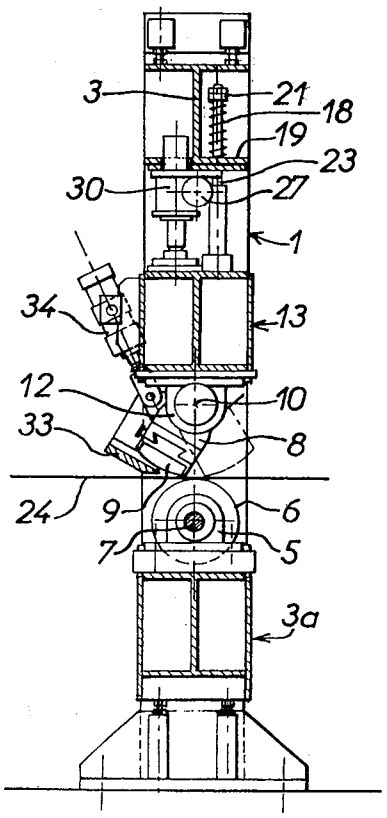
FIG. 2 is a section taken along the line II—II of FIG. 1, with parts broken away.

The frame structure of the machine comprises a pair of uprights 1 and 2 interconnected at their upper and lower portions by cross members 3 and 3*a*, respectively. Mounted upon the lower cross member 3*a* are a pair of aligned bearings 4 and 5 supporting the shaft of a driving roller 6 rotatably rigid with a power shaft 7. A oscillatable embosser 8 mounted for free oscillatory motion about its shaft 10 is carried by a pair of bearings 11 and 12 and provided with adequate marking punches 9 fastened to its part-cylindrical outer surface, as shown. The bearings 11 and 12 are secured in turn to the bottom face of another, movable cross member 13 adapted to slide vertically in slideways 15 and 16 carried by said uprights 1 and 2, respectively. The weight of said oscillatable embosser 8, of its bearings 11, 12 and also of said movable cross member 13 to which they are secured is balanced or compensated by return compression springs 17, 18 bearing with their lower ends against the bottom horizontal wing 19 of the upper fixed cross member 3 and with their upper ends against adjustable nuts and lock nuts 20, 21 engaging the upper ends of corresponding screw-threaded rods, 22, 23 of which the lower ends are secured to the sliding cross member 13, the upper portions of said rods 22, 23 being surrounded by said springs 17 and 18, respectively.

Thus, it is a simple matter for the operator of the machine to cause the intermediate cross member 13 to slide up or down as required, for modifying at will the height of bearings 11 and 12, and also of the shaft 10 of oscillatable embosser 8 carried by these bearings, as a function of the thickness or gage of the sheets 24 to be marked. For instance, this adjustment may be made by using a handcrank 25 rotatably driving a shaft 26 driving in turn through a pair of worms 27 interconnected via a shaft 28 a pair of nuts 29 and 30 engaging screw-threaded rods 31 and 32 solid with the top surface of said sliding cross member 13.

For marking as desired the metal sheet 24 driven by pairs of rollers (not shown), and guided by a deflector 33 until the sheet engages the driving roller 6 rotating at the same peripheral speed as the rate of travel of said sheet, the oscillatable embosser 8 is released either automatically or manually for example by means of a pneumatic cylinder and piston unit 34, so that the oscillatable embosser 8 will move away from its upstream end position and engage the top surface of the sheet 24 with its lower cylindrical surface 9 supporting the marking punch or punches, whereby said punch or punches are carried along automatically at the proper angular velocity, without any interference from the cylinder and piston unit 34. When the freshly marked sheet 24 has moved past and before the passage of the nextsheet to be marked, the actuator 34 or any other means provided for this purpose will cause through automatic or manual means the oscillatable embosser 8 to move back from its downstream inoperative position to its upstream inoperative position in which it is ready for marking the next sheet.

Of course, the specific form of embodiment of the invention which is described hereinabove and illustrated in the attached drawing should not be construed as limiting the scope of the invention since many modifications and changes may be brought thereto without departing from the basic principles of the invention as set forth in the appended claims, as will readily occur to those skilled in the art. Thus, an elastic, mechanical, hydraulic or pneumatic damper may be provided between the oscillatable embosser 8 and its support means, at any suitable location, for preventing variations in the sheet thickness, within the usual tolerance limits, from interfering with the quality of the marking.

What is claimed as new is:

1. A press for marking sheet-metal articles and stock, comprising a frame structure having a pair of lateral uprights and a vertically movable cross member, slideways on said uprights, said cross member having its ends adapted to slide vertically in said slideways, a roller for driving the sheets to be marked mounted on said frame structure and having the same peripheral velocity as the linear velocity of said sheets, an oscillatable embosser freely pivotable about a shaft supported by a pair of bearings secured to the bottom surface of said cross member for co-action with said roller, said embosser comprising a part-cylindrical segment carrying marking punch means on its outer periphery, means for adjusting the position of said cross member and thereby the position of said embosser in relation to the position of said roller according to the thickness of the sheet to be marked, said embosser having an upstream end position and a downstream end position in which it is out of contact with the sheet to be marked, means for retaining said embosser in said end positions, means for releasing said embosser from said upstream end position to permit it to contact a passing sheet and mark same, said embosser being driven by its contact with the sheet toward said downstream end position to be retained therein, and means for returning said embosser from said downstream end position to said upstream end position before the passage of the next sheet to be marked.

2. A press according to claim 1, wherein said frame structure comprises a second cross member fixed at a higher level than said movable cross member, and vertically adjustable bearing members interconnect said movable cross member and said second cross member.

3. A press according to claim 2, wherein return compression springs bear at lower ends thereof against said second cross member and at upper ends thereof against adjustable nuts carried by upper portions of a pair of screw-threaded rods whose lower ends are secured to said movable cross member, said upper portions of said screw-threaded rods being surrounded by said springs, the force of said return springs being calculated to compensate the weight of said embosser, the bearings supporting said embosser, and said movable cross member.

4. A press according to claim 1, wherein said means for adjusting the position of said cross member comprises a hand crank, a shaft rotatably driven by said hand crank, two worm means coupled to a second shaft rotatably driven by the first said shaft, a pair of nuts each rotatably driven by one of said worm means, and two screw-threaded rods each engaged by one of said nuts, said rods being rigid with the top surface of said movable cross member.

5. A press according to claim 1, wherein said means for retaining said embosser in said end positions comprises a pneumatic cylinder and piston unit.

6. A press according to claim 5, wherein said means for releasing said embosser from said upstream end position also comprises said pneumatic cylinder and piston unit.

7. A press according to claim 6, wherein said means for returning said embosser from said downstream end position to said upstream end position also comprises said pneumatic cylinder and piston unit.

* * * * *